United States Patent [19]

Dabrowski

[11] Patent Number: 4,997,405

[45] Date of Patent: Mar. 5, 1991

[54] COIN PAYOUT SYSTEM

[75] Inventor: Stanley P. Dabrowski, Euclid, Ohio

[73] Assignee: Ardac, Inc., Eastlake, Ohio

[21] Appl. No.: 343,998

[22] Filed: Apr. 26, 1989

[51] Int. Cl.[5] ..... G07D 1/00

[52] U.S. Cl. ..... 453/57; 221/237; 221/265

[58] Field of Search ..... 453/12, 13, 32, 33, 453/34, 40, 49, 57; 221/182, 234, 237, 265, 200, 201; 222/370, 354, 264, 273, 274, 239

[56] References Cited

U.S. PATENT DOCUMENTS

| | | | |
|---|---|---|---|
| 3,814,296 | 6/1974 | Tschritter | 222/220 |
| 4,304,247 | 12/1981 | Hasegawa | 221/182 X |
| 4,398,550 | 8/1983 | Shireman | 453/32 |
| 4,407,312 | 10/1983 | Davila et al. | 453/33 X |
| 4,441,515 | 4/1984 | Goepner | 453/32 |
| 4,466,453 | 8/1984 | Said et al. | 453/17 X |

FOREIGN PATENT DOCUMENTS

| | | | |
|---|---|---|---|
| 105398 | 6/1963 | Netherlands | 221/182 |

*Primary Examiner*—F. J. Bartuska

*Attorney, Agent, or Firm*—Renner, Kenner, Greive, Bobak, Taylor & Weber

[57] ABSTRACT

A coin payout system for a currency validator is presented. The system includes a bulk coin hopper having a pair of rotating discs at the bottom thereof. The discs each have a hole passing therethrough, with the holes of the two discs being in periodic registration with each other to pass coins from the bulk hopper to a dispensing area. One of the discs is caused to rotate at twice the speed of the other disc to accommodate the transfer function.

11 Claims, 2 Drawing Sheets

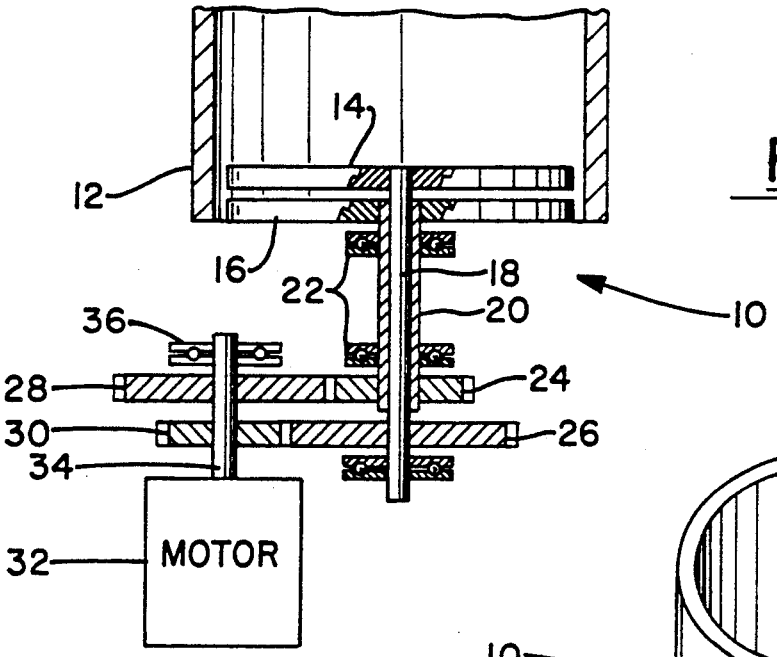
FIG.-1
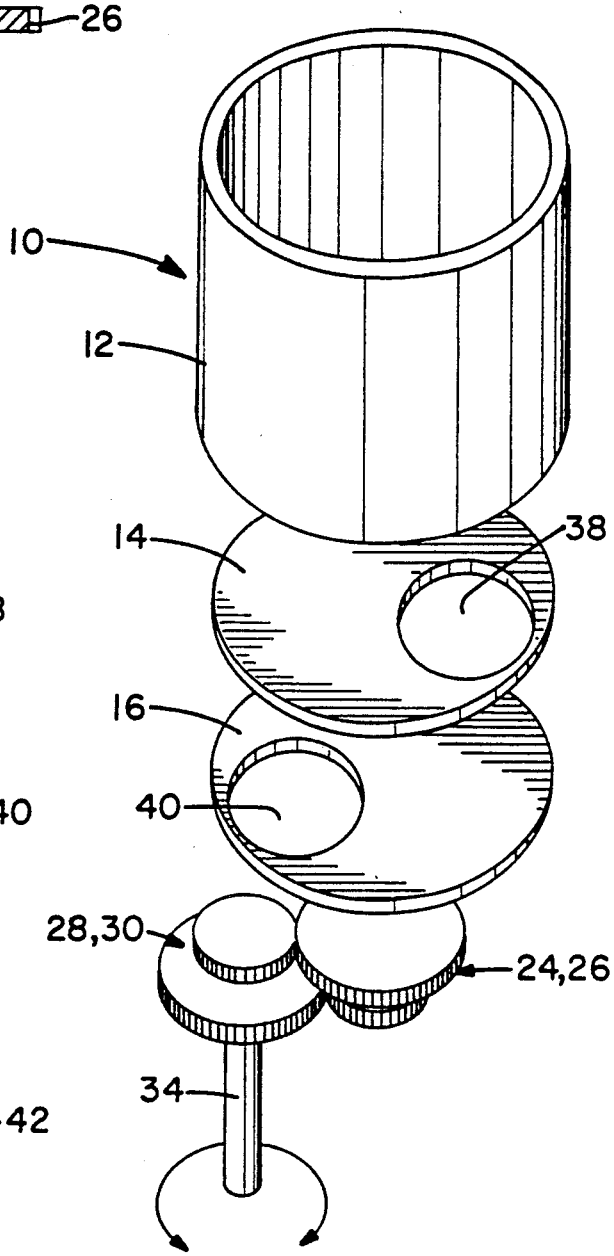
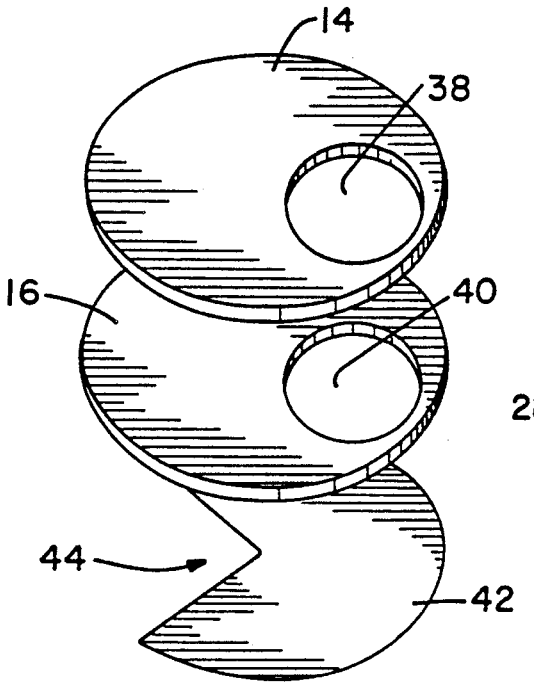
FIG.-3
FIG.-2

COIN PAYOUT SYSTEM

TECHNICAL FIELD

The invention herein resides in the art of bulk coin hoppers of the type typically used in currency changers or the like. Specifically, the invention relates to a bulk hopper for use in association with a validator, changer, or other equipment requiring dispensing of coins, tokens, or the like.

BACKGROUND ART

Heretofore, various types of coin or token hoppers have been known and utilized in the changer and dispensing art. A common type is that known as an indirect payout hopper in which coins are loaded into a hold or escrow position from which they are subsequently dispensed when the validity of tended currency is determined. In such systems, a belt is often used to transport coins from a bulk chamber to a chute or channel in which they are maintained until a payout is requested. In these systems, two steps for any payout are required, the first being the loading of the chute or channel and the second being the actual vending of the coins. Also slowing down the changing process is the fact that the chutes or channels have typically been too small to maintain sufficient coins for changing larger denominations of currency.

Known direct payout hoppers have often incorporated a large rotating disc having protrusions thereon which engage coins and carry them past a stripper where coins are separated from each other and subsequently dispensed by gravity. Such prior systems require repetitive servicing to assure proper operation.

Other direct payout hoppers utilizing one or more pairs of rotating discs with out without coin-receiving receptacles therein, have been known. U.S. Pat. Nos. 3,814,296, 4,398,550, 4,466,453, and 4,441,515, as well as European Patent 204,405 teach such structures and techniques. However, such prior art structures have been rather complex in nature and given to varying degrees of unreliability in service and operation.

In light of the forgoing, there was recognized a need for a direct payout hopper which is rapid and reliable in operation. Such a hopper needs to accommodate the changing of large bills in short time cycles such as by dispensing the coins directly from a bulk hopper without having to transport the coins to escrow or a hold position first. Accordingly, the only limitation for the number of coins to be dispensed in a single dispensing operation would be the volume of the hopper itself. In light of prior art structures which have sought these advantages, it is also been recognized that there is a need for a system in which the coins being transferred from one receptacle to another evidence a significant dwell time of the two receptacles so that the transfer may be reliably made.

DISCLOSURE OF INVENTION

In light of the forgoing, it is a first aspect of the invention to provide a bulk coin hopper which achieves a direct payout of coins in response to an appropriate request.

Another aspect of the invention is the provision of a bulk coin hopper which is rapid in operation.

Another aspect of the invention is the provision of a bulk coin hopper having a minimum number of moving parts which may be housed in a compact unit.

A further aspect of the invention is the provision of a bulk coin hopper which is reliable and durable in operation.

Still an additional aspect of the invention is the provision of a bulk coin hopper which is not susceptible to jamming or misfeeding.

Still a further aspect of the invention is the provision of a bulk coin hopper which can receive and store a large volume of coins in a small amount of space.

An additional aspect of the invention is the provision of a bulk coin hopper in which moving elements within the hopper track each other, allowing for a transfer of coins therebetween at high speeds of operation.

The foregoing and other aspects of the invention which will become apparent as the detailed description proceeds are achieved by: a coin payout system, comprising: a hopper for receiving a bulk supply of coins; a top disc received in a bottom portion of said hopper; and a bottom disc received in said bottom portion of said hopper beneath said top disc, said top and bottom discs each having a hole passing therethrough.

Other aspects of the invention are obtained by a bulk coin hopper, comprising: a receptacle for receiving a bulk supply of coins; and first and second discs received within said receptacle and enclosing a bottom portion thereof, said first and second discs being rotatable about a common axis, and having holes therein in periodic registration with each other, said first disc rotating faster than said second disc.

DESCRIPTION OF DRAWINGS

For a complete understanding of objects, techniques, and structure of the invention, reference should be had to the following detailed description and accompanying drawings wherein:

FIG. 1 is a front sectional view of a coin payout system according to the invention;

FIG. 2 is an illustrative assembly drawing of the hopper, discs, and drive mechanism of the invention;

FIG. 3 is an illustrative view of the interrelationship of the discs of the invention.

BEST MODE FOR CARRYING OUT THE INVENTION

Figure 4:
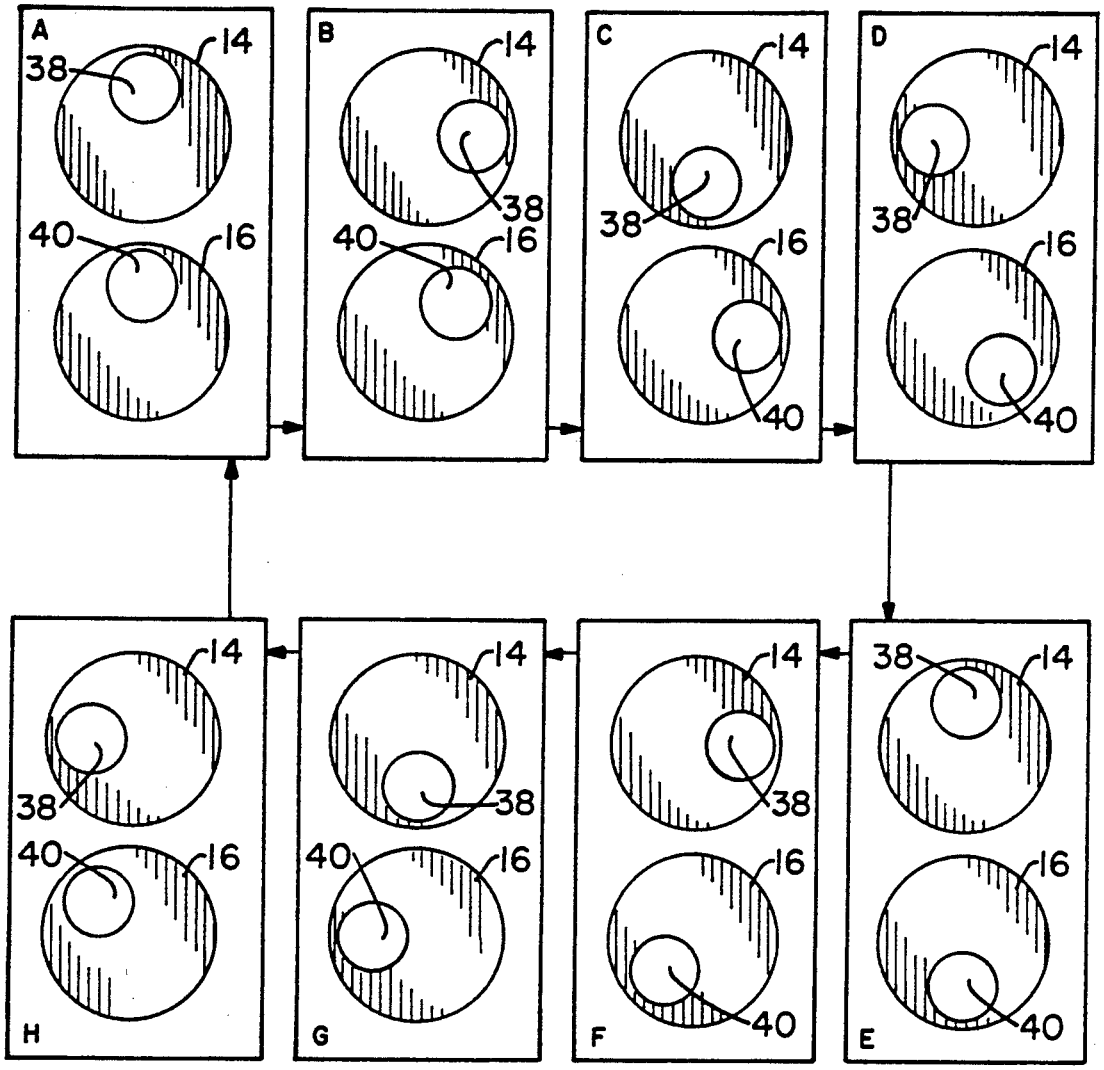
FIG. 4 is an illustration of the operational features of the invention.

Referring now to the drawings and more particularly to FIG. 1, it can be seen that a coin payout system according to the invention is designated generally by the numeral 10. The system 10 includes a hopper 12 which may be any suitable receptacle for receiving and retaining a bulk supply of coins. In a preferred embodiment, the hopper 12 comprises a cylindrical member.

Received at the bottom of the hopper 12 is a top disc 14 and a bottom disc 16, preferably of the same diameter and of substantially the diameter of the bottom of the hopper 12. An inner shaft 18 is connected to the top disc 14, while an external shaft 20 is connected to the bottom disc 16. As shown, the shaft 20 serves as a sleeve for the shaft 18, the external shaft 20 being rotatably supported by the pair of bearings 22 as shown, while the inner shaft 18 is supported by the outer shaft 20 and the lower bearing 22.

A gear 24 is connected to the external shaft 20 to drive the same. In like manner, the gear 26 is connected to the inner shaft 18 for drive purposes. The gear 24 mates with the gear 28, while the gear 26 mates with the gear 30 for drive purposes. The gears 28, 30 are driven by the motor 32 by keyed interconnection with the motor shaft 34 driven within a bearing 36.

It should now be appreciated that actuation of the motor 32 will, through the gears 24–30, rotate the discs 14–16 in the same direction. In one preferred embodiment of the invention, the gear ratios of the gear pairs 24, 28 and 26, 30 are such that the bottom disc 16 rotates at a rotational velocity twice that of the top discs 14.

With reference now to FIG. 2, it can be seen that a hole 38 is provided through the top disc 14, while a hole 40 is provided through the bottom disc 16. For appropriate operation, the centers of the respective holes 38, 40 must not coincide with the centers of the respective discs 14–16. With the discs 14, 16 having their center points lying on a common central axis, it is preferred that the center of the hole 38 be radially spaced from the center of the disc 14 the same distance that the center of the hole 40 is radially spaced from the center of disc 16. Accordingly, when the discs 14, 16 rotate, the center of the hole 38 defines a circle which is congruent with the circle defined by the center of the hole 40 when the disc 16 rotates. While it is preferred that the holes 38, 40 be of the same diameter, slightly larger than the coins to be received thereby, the hole 40 may be of a slightly larger diameter than the hole 38 for purposes of accommodating the necessary periodic registration between the two as will be discussed later herein. It should also be appreciated that the thickness of the discs 14, 16 is slightly greater than the thickness of the coins to be received within the holes 38, 40, but preferably not more than 50 percent thicker such that the holes 38, 40 will only accommodate one coin at a time, while accommodating bent coins. The resulting extra depth of the holes 38–40 will accommodate bent coins without jamming of the system.

As shown in FIG. 3 there may also be provided a stationary plate 42 beneath the bottom plate 16. This stationary plate 42 has a sector 44 removed therefrom defining an area through which coins may be dropped from the hole 40 into a chute or other appropriate conduit for passing the coins to the user. Obviously, the size of the sector 44 will also be dependent upon the size of the coins to be dispensed from the hopper 12. As shown in FIG. 3, the sector 44 is on the order of 90 degrees.

For an appreciation of the operation of the invention, reference should be had to FIG. 4. To achieve the objects of the invention, it is most desirable that the discs 14, 16 rotate in the same direction with one of the discs rotating at twice the speed of the other. FIG. 1 shows an embodiment in which the bottom disc 16 rotates at twice the speed of the top disc 14, while FIG. 2 illustratively shows an assembly in which the gears 24–30 are reversed, causing the top disc to rotate at twice the speed of the bottom disc. In either event, the resultant efficiency of the unit will remain the same. The illustration in FIG. 4 is predicated on the concept that the top disc 14 will rotate at twice the speed of the bottom disc 16.

The illustration in FIG. 4 presents the positional relationships of the top and bottom discs 14, 16 at eight (8) points during one rotation of the motor shaft 34. At point A, the holes 38, 40 of the discs 14, 16 are in alignment with each other such that a coin received in the hole 38 is passed by gravity to the lower hole 40. This transfer of coins between the holes occurs at the time of registration between the two. Since the discs 14, 16 rotate in the same direction, by providing the lower hole 40 with a slightly larger diameter than the upper hole 38, the dwell time between the two holes increases such that the transfer can be made more efficiently. Even with the holes 38, 40 being of the same size, with the discs 14, 16 rotating the same direction there is a finite dwell time between the two holes accommodating the transfer. The discs continue to rotate through points B–E, the hole 40 carrying the coin received at point A from the hole 38, with the hole 38 seeking to obtain a new coin from the bulk supply maintained within the hopper 12. During this rotation, the coin carried by the hole 40 is supported by the plate 42. At point E, the hole 40 is in registration with the open sector 44. A this point, the coin in the hole 40 is dropped through the opening 44 to a chute, conduit, or other appropriate means for transferring the coin to a bowl or the like for receipt by the user.

The discs 14, 16 continue their rotation through steps F–H, the hole 40 being empty at this time, and the hole 38 seeking to obtain a coin from the bulk hopper 12 if it has not yet done so. With a high degree of efficiency, it has been found that the hole 38 will obtain such a coin passing through the steps A–H. With the coin having been so obtained, it is transferred from the hole 38 to the hole 40 at point A, when those holes are in registration, and the cycle continues.

It should now be clear that the discs 14, 16 may rotate in either direction and dispense coins so long as both rotate in the same direction. Should the discs jam, the motor 32 may be reversed to relieve the jam. Operation may then continue in the reverse direction until there arises a subsequent need to again change rotational direction.

It will, of course, be understood that suitable control means are included in association with the system 10 to assure that the proper number of coins are dispensed. It is well know in the art, and within the capabilities of those skilled in the art, to provide an appropriate counter such as a photo detector or the like to control the motor 32 for appropriate actuation. It is also within the capabilities of those skilled in the art to eliminate the gearing 24, 30 and replace the discs 14, 16 with discs having gear teeth on the edges thereof to be driven by an appropriate pinion. Such a structure allows the discs to have a diameter less than twice the diameter of the coins being dispensed, providing for a compact bulk coin hopper unlike any previously known. Obviously, a number of variations on the theme of this invention are possible to those skilled in the art, now having the benefit of the teachings above.

Thus it can be seen that the objects of the invention have been satisfied by the structure presented hereinabove. While in accordance with the Patent Statutes only the best mode and preferred embodiment of the invention has been presented and described in detail, it is to be understood that the invention is not limited thereto or thereby. Accordingly, for an appreciation of the true scope and breath of the invention reference should be had to the following claims.

What is claimed is:

1. A coin payout system, comprising:

a hopper for receiving a bulk supply of coins;

a top disc received in a bottom portion of said hopper; and a bottom disc received in said bottom portion of said hopper beneath said top disc, said top and bottom discs rotating at different speeds in the same direction about a common axis, each of said discs having a hole passing therethrough, said holes in said top and bottom discs being in periodic registration with each other when said top and bottom discs are rotating.

2. The coin payout system according to claim 1, wherein said top plate rotates at a speed twice that of the bottom plate.

3. A coin payout system according to claim 1, further comprising a third stationary plate beneath said bottom plate, said bottom plate rotating upon said third stationary plate.

4. The coin payout system according to claim 3, wherein said third stationary plate has an opening therethrough for receipt of coins passing therethrough.

5. The coin payout system according to claim 4, wherein said opening of said bottom plate is in communication with said opening of said third stationary plate when said opening of said top and bottom plate are diametrically opposite each other with respect to said common axis.

6. The coin payout system according to claim 5, wherein said holes in said top and bottom plates are sized to receive coins of said hopper.

7. A bulk coin hopper, comprising:

a receptacle for receiving a bulk supply of coins; and first and second discs received in said receptacle and enclosing a bottom portion thereof, said first and second discs being rotatable about a common axis and having holes therein in periodic registration with each other, sai first disc rotating faster than said second disc, said holes in said first and second discs being of substantially equal size, the centers of such holes defining congruent circles as said respective discs rotate.

8. The bulk coin hopper according to claim 7, further comprising a base plate receiving said second disc.

9. The bulk coin hopper according to claim 8, wherein said base plate has an opening therein in periodic communication with said hole passing through said second plate.

10. The bulk coin hopper according to claim 9, wherein said first plate has a rotational speed twice that of said second plate.

11. The bulk coin hopper claimed in claim 10, wherein said first and second plates are greater in thickness than the thickness of each of said coins but less than twice the thickness thereof.

* * * * *